US005895286A

United States Patent [19]

Linke

[11] Patent Number: 5,895,286

[45] **Date of Patent: *Apr. 20, 1999**

[54] TERMINAL FOR ELECTRICAL INSTALLATIONS

[75] Inventor: Rainer Linke, Gummersbach, Germany

[73] Assignee: Albert Ackermann GmbH & Co. KG, Gummersbach, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/649,671

[22] PCT Filed: Aug. 25, 1995

[86] PCT No.: PCT/EP95/03362

§ 371 Date: Jul. 9, 1996

§ 102(e) Date: Jul. 9, 1996

[87] PCT Pub. No.: WO96/09664

PCT Pub. Date: Mar. 28, 1996

[30] Foreign Application Priority Data

Sep. 23, 1994 [DE] Germany ..... 44 33 983

[51] Int. Cl.[6] ..... H01R 4/24

[52] U.S. Cl. ..... 439/441; 439/629; 439/725

[58] Field of Search ..... 439/436–441, 439/268, 725

[56] References Cited

U.S. PATENT DOCUMENTS

| | | | |
|---|---|---|---|
| 4,978,315 | 12/1990 | Edgley et al. | 439/441 |
| 5,069,638 | 12/1991 | Schalk | 439/439 |
| 5,454,730 | 10/1995 | Tozuka | 439/441 |
| 5,484,304 | 1/1996 | Capper et al. | 439/441 |

FOREIGN PATENT DOCUMENTS

| | | |
|---|---|---|
| 0 401 938 | 12/1990 | European Pat. Off. . |
| 2 524 721 | 3/1982 | France . |
| 2 027 863 | 12/1971 | Germany . |
| 40 14 048 A1 | 10/1991 | Germany . |
| 43 19018 C1 | 6/1993 | Germany . |

*Primary Examiner*—Hien Vu
*Attorney, Agent, or Firm*—Evenson, McKeown, Edwards & Lenahan, PLLC

[57] ABSTRACT

Prior art terminals with operating buttons and a contact member movable against the force of a spring are relatively bulky and complex. It is proposed to provide a part of a curved leaf spring as the contact member having at least one aperture fitted in such a way above the conductor guide that an edge of the aperture acts as the contact member. This design also permits the contacting of thin conductors.

18 Claims, 3 Drawing Sheets

TERMINAL FOR ELECTRICAL INSTALLATIONS

BACKGROUND AND SUMMARY OF THE INVENTION

The invention relates to a terminal for electrical installations, particularly for applied computer science, having a contact member which can be moved in a housing and which, under the force of a spring, can be pressed against a guide for a conductor which is open in the direction of the contact member, the contact member being part of a leaf spring which is held in the housing and is provided with an opening which is arranged in such a manner with respect to the guide for the conductor that an edge is used as the contact member and can be placed against the conductor.

Terminals with actuating keys are known. As a rule, these consist of a U-shaped component which surrounds a guide duct for the conductor and, by way of the leg facing away from the key part, forms the contact member which, under the force of a spring, is pressed into the guide duct for the conductor for contacting it.

The manufacturing of such constructions requires relatively high expenditures. Mainly, they will no longer allow any reliable contacting when the diameters of the conductors become very thin, which is particularly the case in applied computer science and communications technology. The space requirement of the known construction is also relatively high. Therefore, if a large number of connections is required, which is the case in communications technology, the space requirement for such terminals will become considerable.

A terminal of the initially mentioned type is also known (U.S. Patent Document U.S. Pat. No. 5,069,638). There, a leaf spring is provided which is clamped on one side into a housing opening and which has an opening (or a recess) whose upper edge, as the contact member, rests in a clamping manner against the conductor which, on the other side, is held on the wall of a guide in the housing. Since, in this type of construction, only an opening for the guiding-through of the conductor is provided, it becomes necessary to clamp the end of the leaf spring which is not provided with the opening fixedly in the housing.

The invention is based on the object of developing a terminal of the initially mentioned type in such a manner that, while the space requirement is low, it can also be used for the secure contacting of thin conductors.

For achieving this object, the leaf spring of a terminal of the initially mentioned type is provided with rectangular apertures which are arranged below one another in an aligned manner. The leaf spring is placed in a curved shape on the guide for the conductors such that one of the apertures is used as a clamping member for fastening the leaf spring on the guide for the conductor, and an edge of the other aperture forms the contact member. The curved leaf spring is inserted between the bottom of a shaft in the housing and an actuating key. This embodiment is extremely simple. However, it permits the implementation of relatively high contact pressures since, as a result of the use of a leaf spring, high elastic forces are available and the contact member only has a small contact surface. This embodiment is therefore advantageous particularly for contacting thin conductors which are also held securely in terminals according to the invention.

The construction is particularly advantageous if, as a further development of the invention, the conductor guide, in each case, consists of two parallel strip profiles which are provided with an approximately V-shaped cross-section and which are connected with a connection contact. The leaf spring can be clamped in a simple manner by its aperture on these strip profiles. A conductor placed in the conductor guide can, on the one hand, be perfectly contacted with the edge of the second aperture forming the contact member, but, on the other hand, can also be fixedly pressed into the V-shaped indentation of the strip profile and can be held there.

In the case of this embodiment, it is advantageous as a further development of the invention to provide the actuating key with plug-in openings for the conductors to be connected which are aligned with the longitudinal direction of the strip profiles. No additional space is therefore required transversely to the actuating direction of the actuating key.

In a further development of the invention, the leaf spring may be constructed in one piece with a second leaf spring and may be provided with a separating cut extending between the strip profiles. Despite the arrangement of only one leaf spring part, this construction also allows the contacting of conductors of different diameters, which naturally would also be possible when two leaf springs are used for the two strip profiles forming the conductor guide. However, the latter construction would require higher expenditures with respect to the manufacturing as well as with respect to the mounting.

In a further development of the invention, the connection contact may be constructed in one piece with the strip profiles and may be provided with at least one detent for the locking on the housing. This permits a relatively simple manufacturing.

In this case, the connection contact may be constructed as a solder lug projecting out of the housing. However, it may also be provided with two contact studs for the direct plugging of printed circuit boards, in which case these contact studs may also be arranged at 900° or at 180° with respect to the longitudinal direction of the conductor guides, that is, with respect to the longitudinal direction of the strip profiles. This measure permits the plugging-in of printed circuit boards also at an angle with respect to the plug-in direction for the conductors. Finally, as a further development of the invention, the housing may be provided, on the side opposite the actuating key, with a plug-in opening for the counterplugging of conductors which are aligned with the conductor guides.

According to various embodiments, the invention is illustrated in the drawings and will be explained in the following.

BRIEF DESCRIPTION OF THE DRAWINGS

FIG. 11 is a view of a modified embodiment of the conductor guides with a solder lug arranged in-between;

DETAILED DESCRIPTION OF THE DRAWINGS

FIGS. 1 to 8 show a terminal 1 which is part of a terminal strip 2 which is provided with several terminals which are all arranged in parallel to one another in the terminal strip 2. The embodiment shows only the terminal strip 1 and another terminal strip 3. Since all terminals have an identical construction, the following description is limited to terminal 1.

Figure 8:
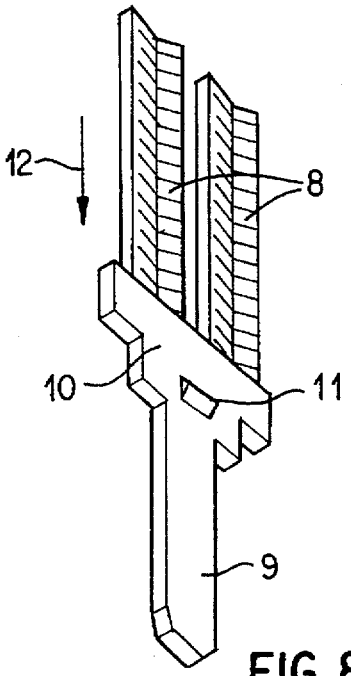
FIG. 8 is a perspective representation of the conductor guides used in the case of the terminal of FIGS. 1 to 5 with the connection contact in the form of a solder lug mounted on the conductor guides.

FIGS. 1 to 5 illustrate that each terminal and also terminal 1 are arranged in a shaft-type cavity (hereinafter shaft) 4 within the housing of the terminal strip 2, and that an actuating key 5 is held in the shaft 4 to be displaceable in the direction of the arrows 6. The actuating key 5 has two openings 7 which have a circular design in the embodiment and widen slightly conically in the upward direction. These openings 7 are aligned with two strip profiles 8 made of a conductive material which are both (see also FIG. 8) connected in one piece with a connection contact 9 designed as a solder lug. In the area of the connection web 10 to the two strip profiles 8, this connection contact 9 has a detent 11 and, when the part illustrated in FIG. 8 is plugged in the direction of the arrow 12 into the shaft 4, the connection contact 9 can be locked by this detent in an opening of the shaft 4 and of the housing 2 which is not illustrated in detail. In the same manner, the actuating key 5 also has laterally projecting detents 13 which have the purpose of preventing the actuating key 5 from falling out in the upward direction after the insertion into the shaft 4.

Between the actuating key 5 and the bottom 4*a* of the shaft 4, a leaf spring 14 (see FIG. 6 and 7) is inserted which, when inserted into the shaft 4, is prestressed and is therefore supported by means of its lower end on the bottom 4*a* and by means of its upper end on a projection 30 of the actuating key 5. The leaf spring 14 in this case consists of two partial leaf springs 14*a* and 14*b* which are separated from one another in their function by a separating cut 15 and are each provided with two apertures 16 and 17 and are connected with one another in one piece in their lower area. The apertures 16 and 17 have a rectangular construction. Apertures 16 are constructed to be significantly larger than apertures 17. The lateral edges of the apertures 16 and 17 are aligned with one another in such a manner that the apertures 16 and 17 are in each case also disposed below one another in an aligned manner.

Figure 1:
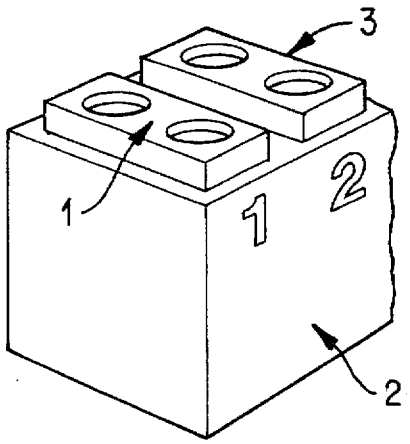
FIG. 1 is a perspective, schematic partial view of a terminal strip with two terminals according to the invention.
Figure 2:
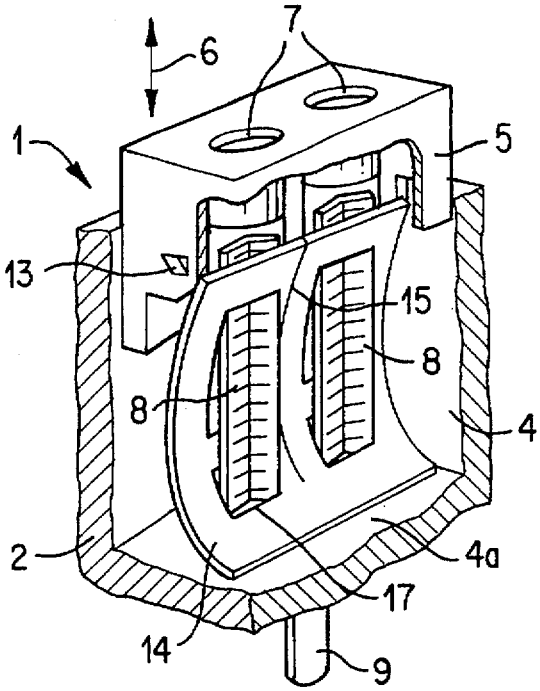
FIG. 2 is an opened-up perspective view of the inside of one of the terminals of FIG. 1.
Figure 3:
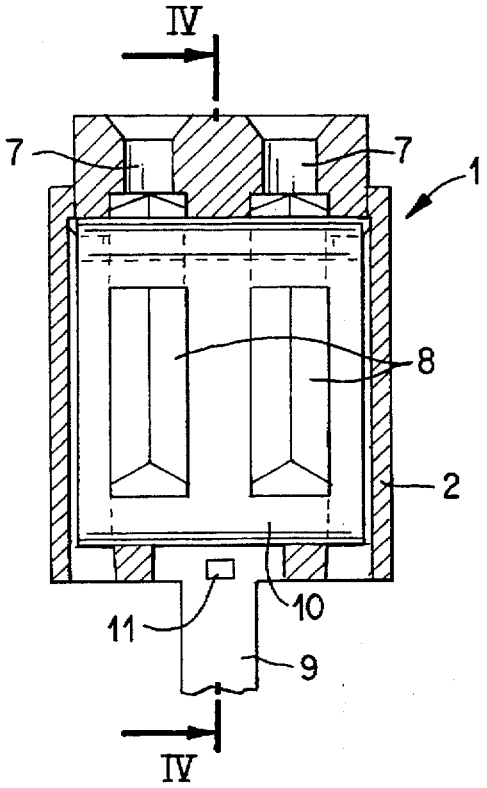
FIG. 3 is a cross-sectional view of a terminal of FIG. 1 and 2 in a sectional view according to Line III—III of FIG. 5.
Figure 4:
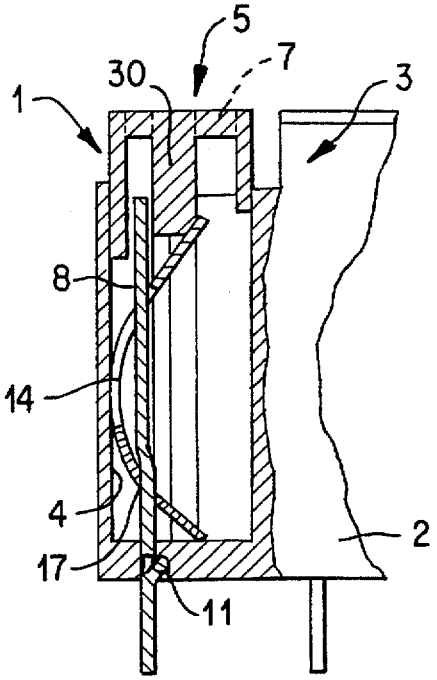
FIG. 4 is a sectional view of the terminal of FIG. 3 along intersection line IV—IV.

The dimensions of the apertures 17 are selected such that the upper and lower edges, in each case, engage the strip profiles 8 when the leaf spring 14, as illustrated in FIGS. 2 and 4, is placed by way of both apertures 16 and 17 onto the strip profiles 8. The leaf spring 14 assumes a curved shape such that the upper edge 16*a* of each of the apertures 16 and forms a contact member with the strip profiles 8 and the two edges of the aperture 17 extending in parallel to the edge 16*a* rest against the strip profiles 8.

Figure 5:
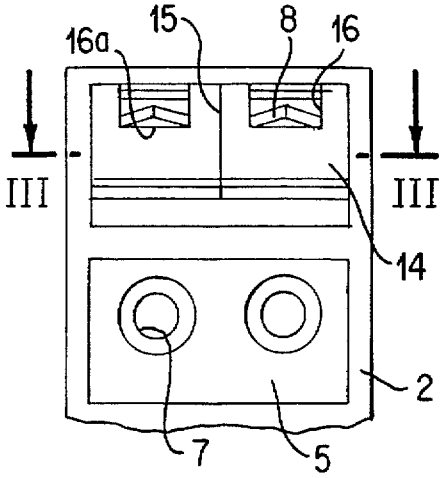
FIG. 5 is a top view of the terminal strip of FIG. 1, in which case the first of the terminals is illustrated without any actuating key.
Figure 6:
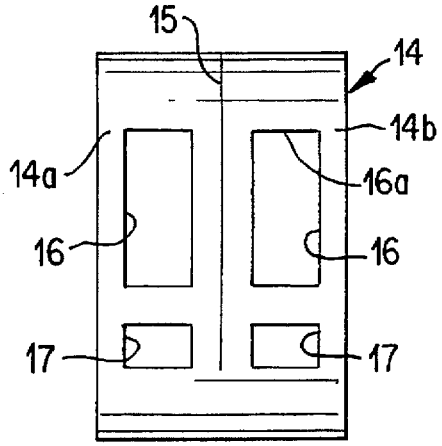
FIG. 6 is a frontal view of the leaf spring used in the embodiment of FIGS. 1 to 5.
Figure 7:
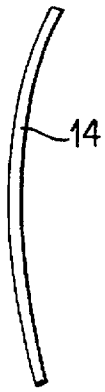
FIG. 7 is a lateral view of the leaf spring of FIG. 6 in the condition before the installation into the terminal.

The strip profiles 8 are designed as conductor guides and are constructed approximately in the form of grooves with an approximately V-shaped cross-section in which the ends of conductors, which are not shown, for the purpose of the contacting, can be introduced through the openings 7 of the actuating key 5. The conductor ends will then be in contact inside the groove guide of the strip profiles 8 and are pressed, by the edge 16*a* (see FIG. 5), fixedly and securely against these strip profiles 8 such that the edges 16*a* do not rest directly against the strip profiles 8, as illustrated in FIG. 5, but rest against the outer surface of correspondingly slid-in conductors. FIG. 5 also shows clearly that, because of the arrangement of the separating cut 15, conductors of different diameters can also be introduced through the openings 7, which conductors can then also be contacted by the respective edge 16*a* of the pertaining leaf spring 14*a* or 14*b*.

The manufacturing of the terminal according to the invention takes place automatically in a simple manner such that first the leaf springs in a curved condition are placed on the assigned strip profiles 8, then the strip profiles with the placed leaf spring with their connection contact 9 are slid through the corresponding aperture 17 (FIG. 4) of the shaft 4 until the detent 11 snaps in and then the actuating key 5 is fitted on which is secured in position by its detents 13, which reach behind corresponding projections of the shaft 4. In this condition, the leaf spring is situated in the shaft 4 under tension. When the key 5 is actuated, the upper position of the leaf spring is bent downward (the lower portion can be fixedly locked on the strip profiles 8 by the aperture 17), so that its edge 16*a*, which therefore also forms the contact member, is removed from the strip profiles 8 and permits the introduction of a conductor end.

Figure 9:
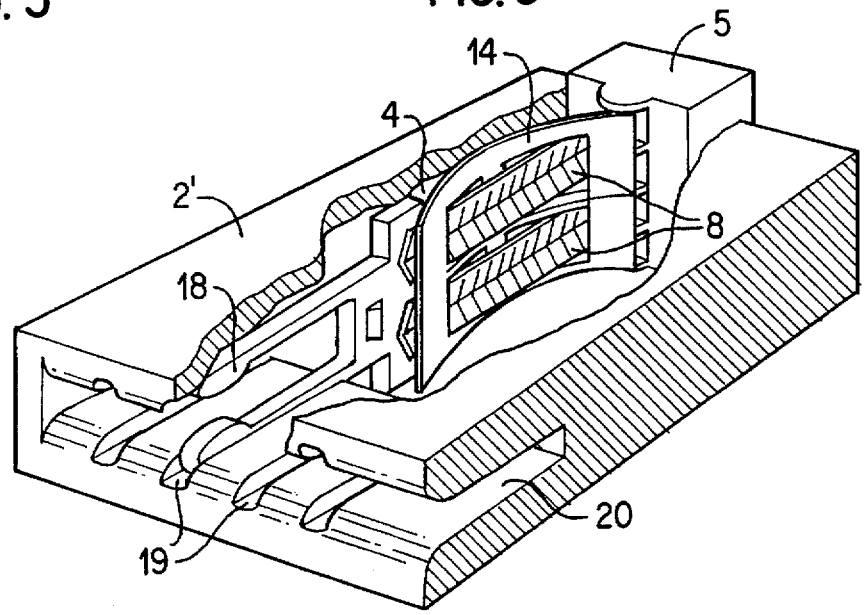
FIG. 9 is a view of a modified embodiment of a terminal according to the invention in which the connection contact is designed in the shape of two contact studs arranged while forming a fork-shaped receiving device which contact studs are used for the direct plugging of printed circuit boards.

FIG. 9 illustrates a modification of the terminal according to the invention to the extent that no solder lug 9 is connected in one piece with the two strip profiles 8, but two contact studs 18 which form a fork-type plug-in device and are used as connection contacts. However, in this variant, the contact studs 18 do not project freely out of the housing of the terminal strip 2 but are held in a housing 2' of a terminal strip which otherwise is also designed for several terminals and which also surrounds the ends of the contact studs 18 which are guided in corresponding slots 19 of the housing 2'. In addition, the housing 2' has an insertion slot 20 so that slid-in printed circuit boards may directly contact the contact studs 18. The remaining construction of the actuating key 5 and of the strip profiles 8 arranged in a shaft 4 and serving as the conductor guide is identical to the embodiment of FIGS. 1 to 8.

Figure 10:
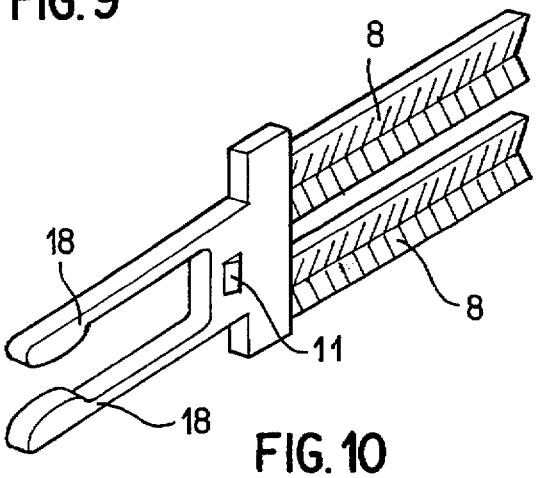
FIG. 10 is a representation of the conductor guides with the contact studs of FIG. 9.
Figure 11:
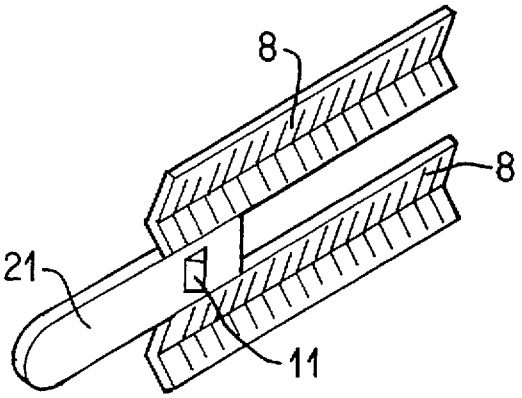
Figure 12:
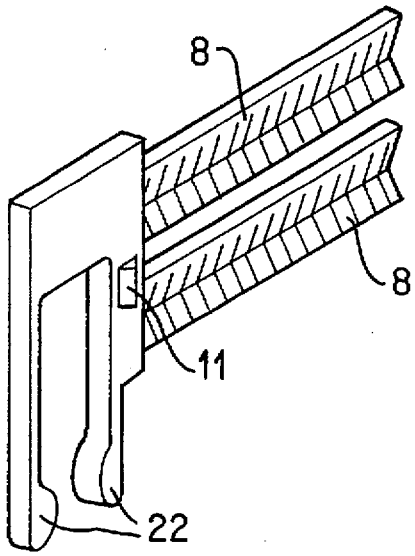
FIG. 12 is a view of another variant of the conductor guides having a fork-shaped plug-type stud which, however, is at an angle of 90° with respect to the longitudinal direction of the conductor guides.
Figure 13:
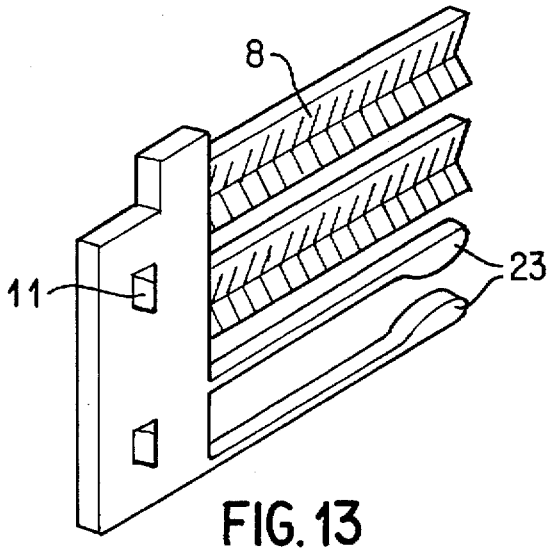
FIG. 13 is a view of a variant of the embodiment of FIG. 12 in which the plug-in studs are displaced by 180° with respect to the longitudinal direction of the conductor guides, that is, in parallel to them.

FIGS. 11 to 13 show embodiments of a connection contact similar to FIG. 8 or similar to FIG. 10. In this case, FIG. 11 illustrates that the solder lug, which may also be a plug-in pin, is plugged in directly between the two strip profiles 8 and is connected with these either in one piece or by welding. In this case, the plug-in pin 21 has the detent 11 for direct fastening on the housing. The design of the shaft must be adapted correspondingly.

FIG. 12 illustrates a variant of the contact studs of FIG. 10 in which the plug-in studs 22 project at 90° with respect to the longitudinal direction of the strip profiles 8. In this variant, a direct contact with printed circuit boards can be achieved by introducing the printed circuit boards perpendicularly to the feeding direction of the conductor ends to be connected.

FIG. 13 shows a variant in which the contact studs 23 are offset by 180° with respect to the plug-in direction of the conductors that is, they are arranged in parallel to the strip profiles 8. A direct contact with printed circuit boards can therefore take place from the same side from which the connection of the conductors also takes place. Naturally, the housing form must be correspondingly adapted to the contact studs of FIGS. 12 and 13.

Figure 14:
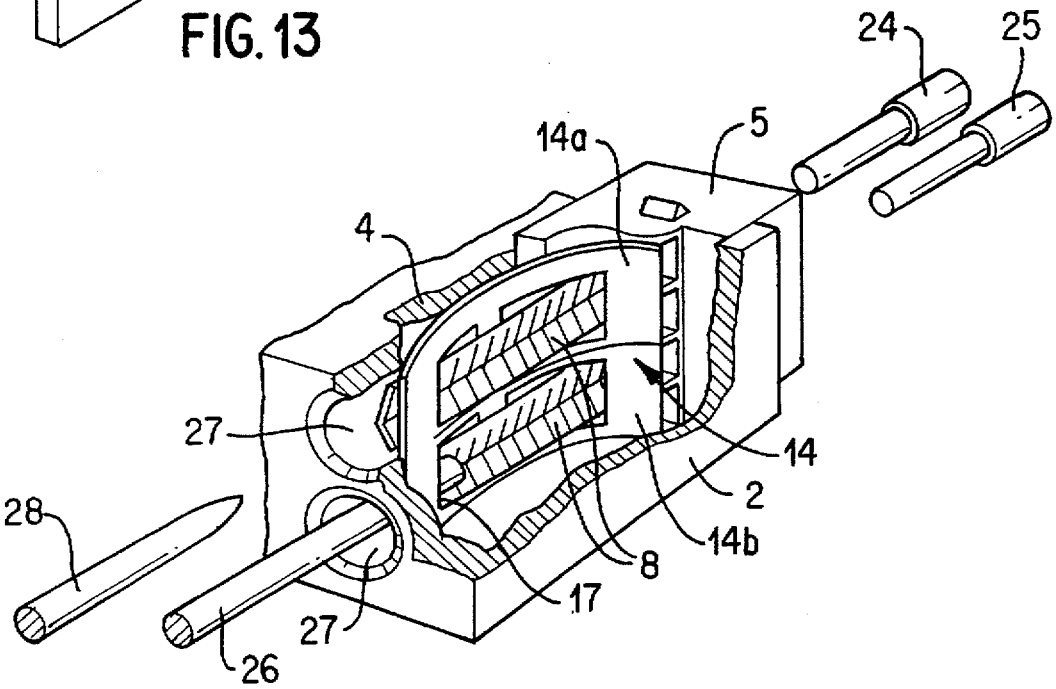
FIG. 14 finally is a view of another variant of a terminal according to the invention in which the countercontact does not take place by means of solder lugs or contact studs but by a direct counterplugging of additional conductors.

FIG. 14 shows the an embodiment in which the two conductors 24 and 25 have different diameters and can be introduced through the openings 7 of the actuating key 5 in the manner described above. From the other side, conductors 26 contact the strip profiles 8 used as conductor guides through openings 27 in the housing 2 of the terminal strip on the bottom of the shaft 4 which, in turn, extend in an aligned manner with respect to the longitudinal direction of the strip profiles 8. In this case, the securing of the position of the strip profiles 8 must be solved by separate measures.

However, the strip profiles 8 may be secured in position by the leaf spring 14 or its parts 14*a*, 14*b* with the apertures 17.

In the case of the embodiment illustrated in FIG. 14, an edge of the aperture 17 is also used to contact the conductor. It is illustrated that the end of the conductor 26 is held between the lower edge of the aperture 17 and the strip profile 8. In the case of this variant, it is advantageous to press away the edges of the aperture 17, which at first are in a firm contact, by means of a suitable tool 28 before the conductor 26 is introduced. This embodiment is particularly recommended when, for example, sensitive and high-expenditure data processing equipment is to be installed in areas to which free access exists before the actual final assembly. In this case, the data processing equipment may be applied to the terminal according to the invention by means of corresponding leads (such as 26) so that, at the time of the final assembly, only the stationarily disposed conductors (such as 24, 25) can be applied to the terminals in a simple manner and without any tools.

What is claimed is:

1. An electrical connection terminal comprising:

a housing having an opening and a bottom portion;

an electrical conductor guide arranged in the housing; and a conductive leaf spring arranged in the housing and comprising a contact edge which is movable and which is pressed by a spring force Provided by said leaf spring against the conductor guide;

the leaf spring defining rectangular apertures which are aligned with each other, said leaf spring being arranged in engagement with said conductor guide such that the leaf spring is placed into a curved form, a first of the apertures positioned adjacent to the bottom portion of the housing including edges for engagement with the conductor guide, and a second of the apertures positioned adjacent to said opening and including an edge forming said contact edge;

wherein the conductor guide comprises two longitudinal strips, the leaf spring comprises two sets of said first and second apertures, and the two longitudinal strips engage respective sets of said first and second apertures.

2. The electrical connection terminal according to claim 1, wherein the conductor guide has a shape which is open in a direction of the contact edge.

3. The electrical connection terminal according to claim 1, wherein the leaf spring is inserted between the bottom portion of the housing and an actuating key located opposite said bottom portion.

4. The electrical connection terminal according to claim 3, wherein the leaf spring has first and second opposing ends, and wherein said first end rests on said bottom portion of the housing and said second end rests against the actuating key.

5. The electrical connection terminal according to claim 1, wherein the two strips are arranged parallel to one another, have approximately V-shaped cross-sections, and are connected with a connection contact.

6. The electrical connection terminal according to claim 3, wherein the two longitudinal strips are arranged in parallel to one another, have approximately V-shaped cross-sections, and are connected with a connection contact, and wherein the actuating key is provided with insertion openings for receiving conductors, said insertion openings being aligned with respect to longitudinal directions of the longitudinal strips.

7. The electrical connection terminal according to claim 5, wherein the leaf spring is constructed in one piece with a second leaf spring and wherein the leaf spring and the second leaf spring are separated by a separating cut extending in a longitudinal direction and positioned between the two strips.

8. The electrical connection terminal according to claim 7, wherein the connection contact is constructed in one piece with the strips and is provided with at least one detent for locking engagement with the housing.

9. The electrical connection terminal according to claim 7, wherein the connection contact is designed as a solder lug.

10. The electrical connection terminal according to claim 7, wherein the connection contact is provided with two contact studs for direct engagement with printed circuit boards.

11. The electrical connection terminal according to claim 10, wherein the contact studs of the connection contact are configured at an angle of 90° or 180° with respect to the longitudinal direction of the strips.

12. The electrical connection terminal according to claim 3, wherein the housing is provided, on a side opposite the actuating key, with a conductor plug-in opening arranged in alignment with the conductor guide.

13. The electrical connection terminal according to claim 6, wherein the housing is provided, on a side opposite the actuating key, with conductor plug-in openings which are arranged in alignment with the strip profiles.

14. An electrical connection terminal, comprising:

a housing;

a conductor guide arranged in the housing; and a leaf spring arranged in the housing, said leaf spring defining a pair of apertures aligned with each other, said conductor guide extending through said pair of apertures and placing said leaf spring into a curved shape;

wherein one of said apertures is disposed in a portion of said leaf spring which is biased toward said conductor guide and an edge of said one of said apertures is movable away from said conductor guide.

15. The electrical connection terminal according to claim 14, wherein another of said pair of apertures includes edges which clampingly engage said conductor guide.

16. The electrical connection terminal according to claim 14, wherein the leaf spring is inserted between a bottom portion of the housing and an actuating key located opposite said bottom portion.

17. An electrical connection terminal, comprising:

a housing defining at least one opening for receiving a conductor;

a conductor guide arranged in the housing essentially aligned with said at least one opening; and a leaf spring arranged in the housing, said leaf spring defining a pair of apertures essentially aligned with each conductor guide, each conductor guide extending through said pair of apertures and placing said leaf spring into a curved shape;

wherein a first one of said pair of apertures is located toward said opening in the housing and a second one of said pair of apertures is located away from said opening in the housing, and wherein said second one of said pair of apertures includes edges which clampingly engage said conductor guide.

18. The electrical connection terminal according to claim 17, wherein said first one of said pair of apertures includes a portion which is biased toward said conductor guide, and wherein said portion is movable away from said conductor guide when said conductor is received in said opening.

* * * * *